United States Patent [19]

Inoue et al.

[11] 4,273,595

[45] Jun. 16, 1981

[54] METHOD OF PREPARING THERMOMAGNETICALLY TREATED MAGNETICALLY ANISOTROPIC OBJECTS

[75] Inventors: Kiyoshi Inoue, Tokyo; Hideo Kaneko, Wakabayashi, both of Japan

[73] Assignee: Inoue-Japax Research Incorporated, Kanagawaken, Japan

[21] Appl. No.: 118,792

[22] Filed: Feb. 5, 1980

[30] Foreign Application Priority Data

Mar. 19, 1979 [JP] Japan ..... 54-32649

[51] Int. Cl.[3] ..... C21D 1/04

[52] U.S. Cl. ..... 148/103; 148/108; 75/126 H

[58] Field of Search ..... 148/103, 108; 75/126 H

[56] References Cited

U.S. PATENT DOCUMENTS

| | | | |
|---|---|---|---|
| 2,295,082 | 9/1942 | Jonas | 148/103 |
| 3,138,494 | 6/1964 | Burket et al. | 148/103 |
| 3,203,838 | 8/1965 | Masumoto et al. | 148/108 X |
| 3,660,175 | 5/1972 | Van Melis et al. | 148/103 |
| 3,806,336 | 4/1974 | Kaneko et al. | 75/126 H |
| 3,954,519 | 5/1976 | Inoue | 75/126 H |
| 4,093,477 | 6/1978 | Iwata et al. | 75/126 H |
| 4,171,978 | 10/1979 | Inoue | 75/126 H |
| 4,194,932 | 3/1980 | Iwata | 148/103 X |

*Primary Examiner*—G. Ozaki

*Attorney, Agent, or Firm*—Karl F. Ross

[57] ABSTRACT

A spinodal decomposition-type alloy is thermomagnetically treated for a specific time period at a temperature determined by calculating the spinodal curves of the alloy.

5 Claims, 8 Drawing Figures

METHOD OF PREPARING THERMOMAGNETICALLY TREATED MAGNETICALLY ANISOTROPIC OBJECTS

FIELD OF THE INVENTION

The present invention relates to a method of producing a thermo-magnetically treated magnetic alloy wherein the alloy is subjected to a thermo-magnetic treatment, i.e. a heat treatment in a magnetic field to gain magnetic anisotropy. The alloy in the present invention is particularly concerned with a spinodal decomposition type alloy which is capable of undergoing the spinodal decomposition of its homogeneous $\alpha$ phase to assume a separated two-phase isomorphous structure consisting of $\alpha_1$ phase and $\alpha_2$ phase. The invention relates, more generally, to a heat-treated, multi-component and magnetically anisotropic alloy system which is broadly useful as magnetically hard and semi-hard magnetic materials.

Magnetic alloys to which the principles of the present invention are generally applicable typically include a family whose components are known constituting so-called alnico(Al-Ni-Co-Fe) alloys, a family whose components are known constituting so-called rare-earth alloys such as samarium-cobalt (Sm·x—Co) alloys, a maganese-aluminum (Mn-Al) alloy family, an iron-cobalt (Fe-Co) family and an iron-chromium-cobalt (Fe-Cr-Co) family.

BACKGROUND OF THE INVENTION

Spinodal decomposition type phase transformation in a multicomponent alloy system is described, for example, in U.S. Pat. No. 3,806,336 issued Apr. 23, 1974, U.S. Pat. No. 3,954,519 issued May 4, 1976 and U.S. Pat. No. 4,171,978 issued Oct. 23, 1979. As has been described therein, a certain binary and other metallic system has, in its composition diagram, a "limit of metastability" or "spinodal" which is thermodynamically defined as the locus of disappearance of the second derivative of the chemical free energy with respect to composition of the system. When a high-temperature composition, which is of homogeneous single-phase structure, of the alloy is brought within the spinodal in a low temperature range, it is transformed into a separated two-phase structure, the phase separation being called spinodal decomposition. The decomposed alloy has a periodic microstructure generally in the order of hundreds of angstroms and which consists of composition modulated two isomorphous phases in which one phase is in the form of a fine precipitate unformly distributed in another phase which forms the matrix. It is observed that if the first phase in such a microstructure is magnetic and the second is nonmagnetic, there results a single-domain structure whereby a highly retentive magnetic body can be obtained. In an Fe/Cr/Co alloy, such first phase ($\alpha_1$) is constituted by a Fe/Co-rich ferromagnetic phase and the second phase ($\alpha_2$) is constituted by a Cr-rich paramagnetic phase.

It has been noted that during the cooling process, the high temperature single phase $\alpha$ is decomposed at a certain temperature corresponding to the miscibility gap of the system into two isomorphous phases: $\alpha_1$ and $\alpha_2$ phases. Since $\alpha_1$ phase is magnetic whereas $\alpha_2$ phase is nonmagnetic and because of the ultrafine size (about 0.03 micron diameter) and the desirably elongated shape of each individual of $\alpha_1$ phase precipitates which are uniformly dispersed surrounded by $\alpha_2$ phase precipitates, the resulting structure forms what can be called the single-domain structure.

On the other hand, attempts to thermodynamically analyze and synthesize the equilibrium phase diagrams of $\alpha$Fe-X solid solution by computer calculations have recently resulted in substantial development. It was shown by Hasebe et al (c.f. Japan Society of Metals 1977 Fall Conference Proceedings) that the miscibility gap and its spinodal in $\alpha$Fe-X solid solution are not simple parabolic but are of abnormal shape, extending toward the Fe side and forming a sharp "horn" or a broad bump at the Curie temperature. It was further shown that the addition of cobalt raises excessively the chemical potential of the alloying element in the ferromagnetic state and enlarges remarkedly the magnetic anomalies in the solubility curve as well as the miscibility gap, which are in substantial agreement with the conclusion drawn by the present inventors from experimental data.

Further experimentation by the present inventors has confirmed the presence of the "horn" of the miscibility gap in the phase diagram of the alloy system and has also revealed magnetic properties of alloys in the vicinity of the "horn" as reported by one of the present inventors et al (cf. Japan Society of Metals 1978 April Conference Proceedings). It has been particularly pointed out that the rectangularity of the magnetic hysteresis curve is improved as the composition comes closer to the "horn" from the chromium side.

OBJECT OF THE INVENTION

It is an important object of the present invention to provide an improved method of preparing a hard or semi-hard magnetic alloy from a spinodally decomposable alloy composition.

Another object of the invention is to provide an improved method of preparing a magnetic alloy of excellent anisotropy.

Still another object of the invention is to provide an improved method of the thermomagnetic treatment of a spinodally decomposable alloy composition wherein an optimum range of each of thermomagnetic treatment parameters is established and utilized.

Yet another object of the invention is to provide a method of preparing a magnetic alloy product of improved properties by subjecting the alloy to a thermomagnetic treatment utilizing optimum temperature and treatment time conditions in accordance with a particular composition of the alloy selected.

A further important object of the invention is to provide an improved method of preparing a heat-treated magnetic alloy at an increased product yield with highly uniform magnetic quality.

A yet further object of the invention is to provide a method of heat treatment which is applicable to a wide range of known magnetic alloys and permits known components to be used in relative amounts or proportions substantially outside the ranges which have hitherto been believed to be useful or practical to yield satisfactory magnetic properties, thereby extending the utility composition of such each magnetic alloy.

An additional important object of the invention is to provide a heat-treatment method which permits magnetic alloy products of desired properties to be obtained at a reduced material cost.

A further additional object of the invention is to provide a heat-treatment method whereby the entire production cost to yield magnetic alloy products of desirable performance is reduced and the production facility is simplified.

Another additional object of the invention is to provide an improved thermomagnetic treatment method whereby magnetic alloy products are obtainable with desirable physical and/or chemical properties which vary from those of similar products produced heretofore.

SUMMARY OF THE INVENTION

The present invention is based upon our extensive investigation which has been conducted on alloy compositions proven to lie in the region of "horn" of miscibility gap located in the phase diagram of a given spinodally decomposable alloy. The temperature and time parameters which can be used in a thermomagnetic or aging treatment, i.e. a heat treatment in a magnetic field, of the alloy have been studied and the magnetic properties which ensue have been correlated to these parameters and compositions.

It has already been pointed out that the termodynamic analysis of a spinodal decomposition type magnetic alloy by resolving the free energy of the alloy solid solution into magnetic (ferromagnetic) and non-magnetic (paramagnetic) components shows that it is necessary to modify the miscibility gap and its spinodal conventionally drawn in the phase diagram of the alloy. It has been shown that the miscibility gap and its spinodal curves are not simple parabolic but has a peculiar shape, extending toward the higher temperature and the lower side of the ferromagnetic component and forming there a sharp horn or a broad bump at the Curie temperature. It has further been shown that the addition of a ferromagnetic element may raise excessively the chemical potential of the alloying element in the ferro-magnetic state and enlarges remarkably the magnetic anomalies in the solubility as well as the miscibility gap.

In thermodynamically establishing a satisfactory formula for the free energy of a spinodal decomposition type alloy, it has now been found to be essential that the total free energy of the system further incorporate a term of magnetization free energy to describe the behaviour of the alloy where it is treated thermomagnetically wherein the high-temperature single, isomorphous $\alpha$ phase achieved by solutioning brings about phase separation or is decomposed spinodally into a ferromagnetic $\alpha_1$ phase and a paramagnetic $\alpha_2$ phase in a magnetic field. As a result, it has been found that in the phase diagram, truly reliable spinodal curves are drawn which are further modified from the "horn" pattern mentioned earlier and effective and optimum conditions are established thereby with regard to composition and temperature, and further with regard to treatment time, the parameters which permit the homogeneous $\alpha$ phase to be decomposed into isomorphous $\alpha_1$ and $\alpha_2$ phases under a given magnetic field to yield desired magnetic anisotropy.

In accordance with the present invention there is therefore provided a method of preparing a magnetically anisotropic object from an alloy system capable of undergoing spinodal decomposition wherein a homogeneous $\alpha$ phase is decomposed into a separated ferromagnetic $\alpha_1$ and $\alpha_2$ phases, the method comprising the steps of establishing a formula expressed as a function of temperature and composition for the total free energy of the alloy system, the formula having a nonmagnetic and magnetic terms separated from each other of the chemical free energy of the alloy and further incorporating a free energy term of magnetization of the alloy when it is thermomagnetically treated in a magnetic field; obtaining the second derivative of the formula to calculate a spinodal of the alloy system drawing on a phase diagram, curves representing the so calculated spinodal; and subjecting the alloy to a thermomagnetic treatment under an external magnetic field with temperature and composition conditions falling within an area defined in the phase diagram below the Curie's temperature curve of the alloy system by a first spinodal curve of the curves which represents thermomagnetic treatment parallel to the magnetic field and a second spinodal curve of the curves which represents thermomagnetic treatment perpendicular to the magnetic field.

Preferably, the method according to the present invention further includes the steps of controlling the time period of the thermomagnetic treatment with the decomposition of the alloy into the paramagnetic $\alpha_2$ phase taken as a rate-determining process so that the treatment is terminated substantially before the concentration modulation of the $\alpha_2$ phase traverses the aforementioned first spinodal curve or magnodal.

SPECIFIC DESCRIPTION

Figure 1:
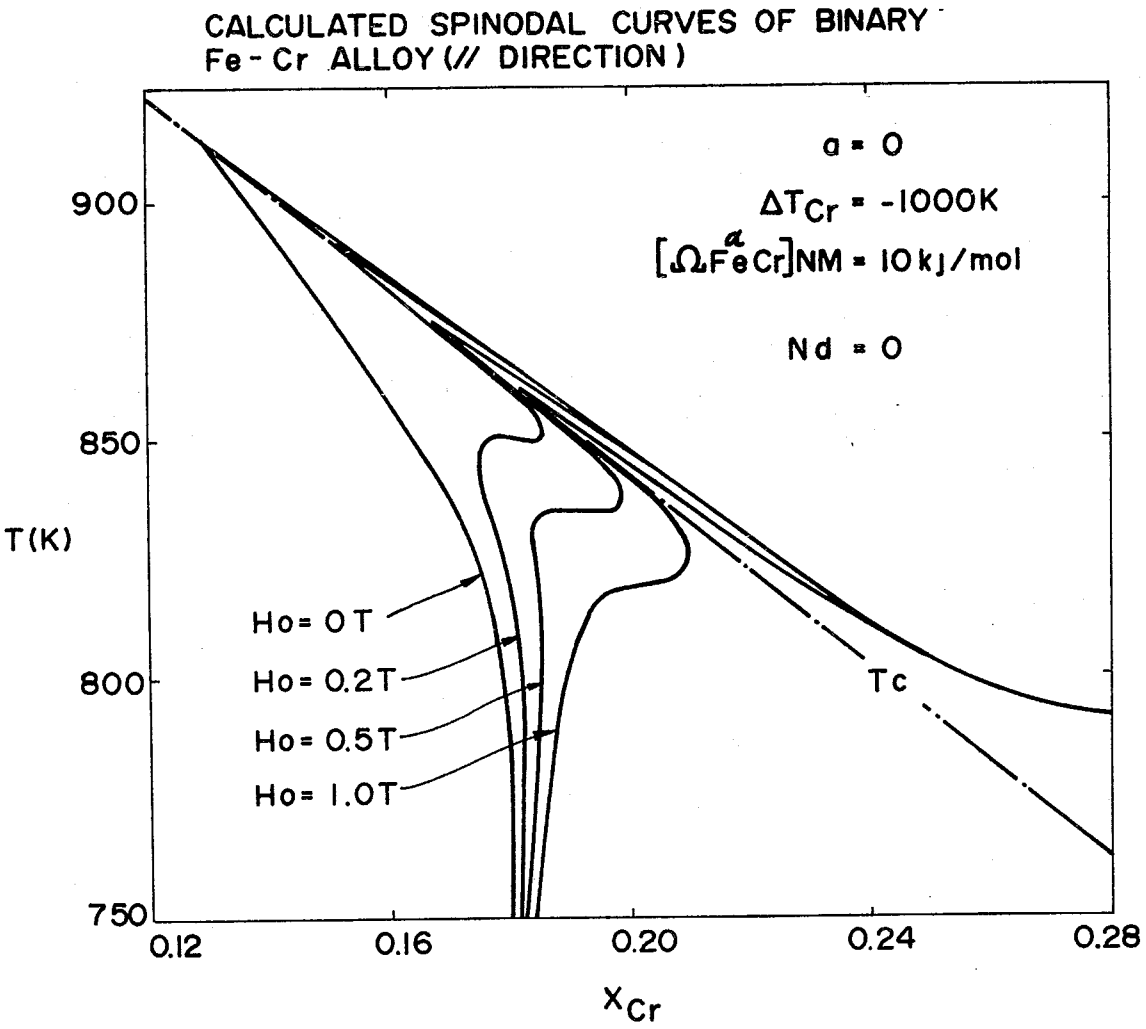
FIGS. 1 to 3 are graphs shown in a phase diagram depicting spinodal curves resulting from varying values of parameters for magnetization and demagnetization applied in a binary Fe-Co alloy, the spinodal curves being those applicable in the direction parallel to magnetization.

The free energy of an $\alpha$Fe-X solid solution can be resolved into their magnetic and non-magnetic components.

$$G^{\alpha}=[G^{\alpha}]_{NM}+[G^{\alpha}]_{Mag} \quad (1)$$

In accordance with the principles of the present invention, we express the total free energy as additionally incorporating a free energy G of magnetization Gm as follows:

$$G^{\alpha}=[G^{\alpha}]_{NM}+[G^{\alpha}]_{Mag}+Gm \quad (2)$$

The term G is divided into a component $G_m\parallel$ parallel to magnetization or the direction of a magnetic field and a component $G_m^{\perp}$ transverse to the magnetization. Since $G_m^{\perp}=0$, it is seen that the equation (2) describes the total free energy in the direction parallel to the magnetic field and is reduced to (1) when it refers to the component perpendicular to magnetization.

In equations (1) and (2), the non-magnetic component $[G^{\alpha}]_{NM}$ can be described in terms of the regular solution model as a function of temperature T and composition X. Thus, with Fe-Cr-Co alloy having composition ($X_{Fe}$, $X_{Cr}$, $X_{Co}$), $$[G^{\alpha}]_{NM}=[{}^0G_{Fe}{}^{\alpha}]_{NM}X_{Fe}+[{}^0G_{Cr}{}^{\alpha}]_{NM}+[{}^0G_{Co}{}^{\alpha}]_{NM}X_{Co}$$
$$+[\Omega_{FeCr}{}^{\alpha}]_{NM}X_{Fe}X_{Cr}+[\Omega_{FeCo}{}^{\alpha}]_{NM}X_{Fe}X_{Co}$$
$$+[\Omega_{CrCo}{}^{\alpha}]_{NM}X_{Cr}X_{Co}+RT(X_{Fe}lnX_{Fe}$$
$$+X_{Cr}lnX_{Cr}+X_{Co}lnX_{Co}) \quad (3)$$

Here, $[{}^0G_{Fe}{}^{\alpha}]_{NM}$, $[{}^0G_{Cr}{}^{\alpha}]_{NM}$ and $[{}^0G_{Co}{}^{\alpha}]_{NM}$ are non-magnetic components of free energy of Fe, Cr and Co atoms, respectively, in $\alpha$-state; $[\Omega_{FeCr}{}^{\alpha}]_{NM}$, $[\Omega_{FeCo}{}^{\alpha}]_{NM}$ and $[\Omega_{CrCo}{}^{\alpha}]_{NM}$ are non-magnetic components of an interaction parameter in regular solution approximation as regards interaction between Fe and Cr atoms, interaction between Fe and Co atoms and interaction between Cr and Co atoms, respectively; and R is the gas-law constant.

The magnetic component can be determined based upon a thermodynamic analysis of magnetic transformation of pure $\alpha$ iron or a hypothetical transformation between its ferromagnetic and paramagnetic states and by modifying the magnetic free energy of pure $\alpha$ iron to take into account the shift of Curie temperature. A further modification is necessary which is concerned with the influence of alloying elements upon the size of the magnetic component on the multi-component alloy system. Thus, the magnetic free energy of $\alpha$Fe-Cr-Co solid solution is approximated as follows:

$$[G^{\alpha}]_{Mag}=(1-m_{Cr}X_{Cr}-m_{Co}X_{Co})\{[{}^0G_{Fe}{}^{\alpha}(T')]_{Mag}$$
$$-(T_c-{}^0T_c)[{}^0S_{Fe}{}^{\alpha}]^p\} \quad (4)$$

where $T'=T-(T_c-{}^0T_c)$.

Here, Tc is the Curie temperature of $\alpha$Fe-Cr-Co alloy; ${}^0$Tc is the Curie temperature of $\alpha$Fe; the term $[{}^0G_{Fe}(T')]_{Mag}$ is the magnetic component of free energy of $\alpha$Fe; and the term $[{}^0S_{Fe}{}^{\alpha}]_{Mag}{}^p$ is the magnetic component of entropy of $\alpha$Fe in p (paramagnetic) state. Parameters $m_{Cr}$ and $m_{Co}$ are inserted to indicate magnetic components of magnetic element Co and non-magnetic element Cr when alloying and can be assumed to be 0 and 1, respectively.

Here, it is also convenient and desirable to express the Curie temperature Tc as a function of composition. Thus, $$Tc = {}^{\circ}Tc + \Delta T_{Cr}X_{Cr} + (\Delta\tau 1 + \Delta\tau 2\frac{X\text{Fe}}{1-X_{Cr}})X_{Co} \quad (5)$$

where it is assumed that Curie temperature in binary $\alpha$Fe-Cr alloy varies linearly as $Tc={}^0Tc+\Delta T_{Cr}X_{Cr}$, and $\Delta\tau 1$ and $\Delta\tau 2$ are constants in Inden's experimental formula $Tc={}^0Tc+\Delta\tau 1X_{Co}+\Delta\tau 2X_{Co}(1-X_{Co})$ which describes a change of Curie temperature in a binary $\alpha$Fe-Co alloy.

In accordance with the principles of the present invention, the further free energy term is now dealt with which additionally to the chemical free energy discussed hereinbefore must be taken into account to describe magnetically aged alloys and which arises from the chemical potential caused in the alloy when it is placed in a magnetic field. This additional energy term, which we here call the free energy of magnetization can be expressed as follows:

$$Gm=-IsH_{ef}V \quad (6)$$

where Is is the spontaneous magnetization of an alloy, Hef is the intensity of an effective magnetic field and V is the molar volume of the alloy. It is assumed that the spontaneous magnetization Is is saturated by the effective magnetic field Hef. Here, the effective magnetic field Hef is expressed as follows:

$$Hef-\begin{cases} H_o - NdIs\ (H_o \geqq NdIs) & (7\text{-}1) \\ O \qquad (H_o < NdIs) & (7\text{-}2) \end{cases}$$

where $H_o$ is an external magnetic field and Nd is a demagnetizing factor determined by the shape of a sample. Thus, assuming that the external field is greater than the demagnetizing field, the expression (6) becomes $$Gm=-VIs(H0-NdIs) \quad (8)$$

It is assumed that the molar volume V of the alloy is constant independently of the composition, temperature and magnetic field.

Under the assumption that the spontaneous magnetization of the alloy is saturated in the direction of the effective magnetic field, there is no component of magnetization and hence no component of free energy of magnetization present in the direction perpendicular to the field. Thus, only with regard to the component parallel to the field should the term of magnetization free energy expressed by (8) be added.

Now let us consider the temperature change of spontaneous magnetization Is. It is assumed that Is varies in accordance with the Weiss' approximation until a certain temperature T* in the vicinity of the Curie's point is reached and then exponentially diminishes below the temperature*, as follows:

$$Is=\begin{cases} I_o\tanh[(\frac{Is}{I_o})/(\frac{T}{Tc})]\ (T \leqq T^*) & (9\text{-}1) \\ I_o\exp[q1(\frac{T}{Tc})+q2]\ (T > T^*) & (9\text{-}2) \end{cases}$$

where $I_0$ is a spontaneous magnetization at 0° K., and q1, q2 and T* are constants determined by actual measurements. It is necessary to transform the implicit function (9-1) to an explicit function. Noting that magnetic aging or thermomagnetic treatment is effected generally near Tc and this allows Is and hence (Is/Io)/(T/Tc) to be smaller, the expression (9-1) can be approximated as follows:

$$Is = I_o\sqrt{3}\ (\frac{T}{Tc})(1-\frac{T}{Tc})^{\frac{1}{2}}\ (T \leqq T^*) \quad (10\text{-}1)$$

It is also noted that constants q1 and q2 contained in the expression (9-2) are related to the upper limit T* of a temperature range in which the Weiss' approximation is met, as follows:

$$q1 = (1 - \frac{3}{2}\ \frac{T^*}{Tc})/\frac{T^*}{Tc}(1 - \frac{T^*}{Tc}) \quad (11\text{-}1)$$

$$q2 = ln[\sqrt{3}\ (\frac{T^*}{Tc})(1 - \frac{T^*}{Tc})^{\frac{1}{2}}] - (1 - \frac{3}{2}\ \frac{T^*}{Tc})/(1 - \frac{T^*}{Tc}) \quad (11\text{-}2)$$

Thus, given T*/Tc, the constants q1 and q2 are determined. If T*/Tc=0.99 is here assumed, the expressions (11-1) and (11-2) yield $$q1 = -49.1,\ q2 = 46.9$$

Accordingly, the spontaneous magnetization Is is expressed as follows:

$$Is = \begin{cases} \sqrt{3}\ I_o(\frac{T}{Tc})(1 - \frac{T}{Tc})^{\frac{1}{2}}\ (T \leqq 0.99Tc) & (12\text{-}1) \\ I_o\exp(q1\frac{T}{Tc} + q2)\ (T > 0.99Tc) & (12\text{-}2) \end{cases}$$

where q1=−49.1 and q2=46.9.

By substituting the expressions (12-1) and (12-2) for the equation (8), the free energy of magnetization in the direction parallel to an external field $H_0$ is expressed as follows:

$$Gm = \begin{cases} -\sqrt{3}\ VIo(\frac{T}{Tc})(1 - \frac{T}{Tc})^{\frac{1}{2}}[Ho - \sqrt{3}\ NdIo(\frac{T}{Tc})(1 - \frac{T}{Tc})^{\frac{1}{2}}]\ (T/Tc \leqq 0.99) & (13\text{-}1) \\ -VI_o\exp(q1\frac{T}{Tc} + q2)[H_o - NdI_o\exp(q1\frac{T}{Tc} + q2)]\ (T/Tc \geqq 0.99) & (13\text{-}2) \end{cases}$$

We now calculate spinodal of αFe-Cr-Co solid solution which is particularly significant with a thermomagnetic treatment wherein the alloy is decomposed in a magnetic field. At this point it should be noted that the development of αFe-Cr-Co alloys is particularly interesting with regard to lower cobalt compositions because of even increasing material cost of cobalt and that the spinodal of the alloy in the low Co range can be regarded as lying parallel with the conjugate curve which has experimentally been determined to define the phase separation of $\alpha$ to $\alpha_1$ and $\alpha_2$. Then, considering a quasi-binary system on the conjugate curve, the spinodal curve can safely be obtained from the equation:

$$\frac{\partial^2 G}{\partial X_{Cr}} = 0 \quad (14)$$

the quasi-binary system being such that $$\frac{X_{Co}}{X_{Co} + X_{Fe}} = \text{a (constant)} \quad (15)$$

Thus, the second derivative of the total free energy of the system is expressed, with regard to the component which is parallel to the magnetic field and the component which is perpendicular to the field, as follows:

$$\frac{\partial^2 G//}{\partial X_{Cr}^2} = \frac{\partial^2[G^\alpha]NM}{\partial X_{Cr}^2} + \frac{\partial^2[G^\alpha]Mag}{\partial X_{Cr}^2} + \frac{\partial^2 Gm}{\partial X_{Cr}^2} = 0 \quad (16)$$

$$\frac{\partial^2 G\perp}{\partial X_{Cr}^2} = \frac{\partial^2[G^\alpha]NM}{\partial X_{Cr}^2} + \frac{\partial^2[G^\alpha]Mag}{\partial X_{Cr}^2} = 0 \quad (17)$$

it being noted that the spinodal in the perpendicular direction to the magnetic field identically represents the spinodal without the field applied.

In order to calculate the equations (16) and (17), the second derivative of the non-magnetic component of chemical free energy can be obtained as follows:

$$\frac{\partial^2[G^\alpha]NM}{\partial X_{Cr}^2} = -2(1 - a)[\Omega^\alpha_{FeCr}] + 2a(1 - a)[\Omega^\alpha_{FeCo}]NM - 2a[\Omega^\alpha_{CoCr}]NM + \frac{RT}{(1 - X_{Cr})X_{Cr}} \quad (18)$$

Similarly, the second derivative of the magnetic component of chemical free energy can be obtained as follows:

$$\frac{\partial^2[G^\alpha]Mag}{\partial X_{Cr}^2} = -2(\frac{\partial Tc}{\partial X_{Cr}})\{[{}^oS^\alpha_{Fe}(T')]_{Mag} - [{}^oS^\alpha_{Fe}]^\beta_{Mag} - (1 - X_{Cr})(\frac{\partial Tc}{\partial X_{Cr}})^2[\frac{\partial {}^oS^\alpha_{Fe}(T')}{\partial T'}]_{Mag}\ (T' = T - (Tc - {}^oTc)) \quad (19)$$

Further, the second derivative of the free energy of magnetization in the equation (16) is:

$$\frac{\partial^2 Gm}{\partial X_{Cr}^2} = -V[\sqrt{3}\ \frac{T}{Tc^3}\ \frac{\partial Tc}{\partial X_{Cr}}\{H_o - 2\sqrt{3}\ Nd\frac{I_oT}{Tc}(1 - \frac{T}{Tc})^{\frac{1}{2}}\} \times \{(I_o\frac{\partial Tc}{\partial X_{Cr}} - 2Tc\frac{\partial I_o}{\partial X_{Cr}})(1 - \frac{3}{2}\ \frac{T}{Tc})(1 - \frac{T}{Tc})^{-\frac{1}{2}} - \frac{I_oT}{Tc}\ \frac{\partial Tc}{\partial X_{Cr}}(1 - \frac{3}{4}\frac{T}{Tc})(1 - \frac{T}{Tc})^{-3/2}\} - 6Nd\frac{T^2}{Tc^2}\{\frac{\partial I_o}{\partial X_{Cr}}(1 - \frac{T}{Tc})^{\frac{1}{2}} - \frac{I_oT}{Tc}\ \frac{\partial Tc}{\partial X_{Cr}}(1 - \frac{3}{2}\ \frac{T}{Tc})(1 - \frac{T}{Tc})^{-\frac{1}{2}}\}^2] \quad (T \leqq 0.99Tc) \quad (20\text{-}1)$$

$$\frac{\partial^2 Gm}{\partial X_{Cr}^2} = -V[\frac{q1T}{Tc^3}\ \frac{\partial Tc}{\partial X_{Cr}}\exp(q1\frac{T}{Tc} + q2)\{H_o - 2NdI_o\exp(q1\frac{T}{Tc} + q2)\} \times \{(I_o\frac{\partial Tc}{\partial X_{Cr}} - 2Tc\frac{\partial I_o}{\partial X_{Cr}}) + \frac{q1I_oT}{Tc}\ \frac{\partial Tc}{\partial X_{Cr}}\} - 2Nd\exp 2(q1\frac{T}{Tc} + q2)\{\frac{\partial I_o}{\partial X_{Cr}} - \frac{q1I_oT}{Tc^2}\ \frac{\partial Tc}{\partial X_{Cr}}\}^2] \quad (T > 0.99Tc) \quad (20\text{-}2)$$

Here,

-continued $$Tc = \{{}^{o}Tc + (\Delta\tau 1 + \Delta\tau 2)a - \Delta\tau 2a^2\} + \{\Delta T_{Cr} - (\Delta\tau 1 + \Delta\tau 2)a + \Delta\tau 2a^2\}X_{Cr} \quad (21)$$

$$\frac{\partial Tc}{\partial X_{Cr}} = \Delta Tc - (\Delta\tau 1 + \Delta\tau 2)a + \Delta\tau 2a^2 \quad (22)$$

$$I_o = ({}^{o}I_o + \Delta K_{Co}a) + (\Delta K_{Cr} - \Delta K_{Co}a)X_{Cr} \quad (23)$$

$$\frac{\partial I_o}{\partial X_{Cr}} = \Delta K_{Cr} - \Delta K_{Co}a \quad (24)$$

$q1 = -49.1,\ q2 = 46.9$

Accordingly, the spinodal parallel to the magnetic field:

$$\frac{RT}{(1-X_{Cr})X_{Cr}} - 2(1-a)[\Omega^{\alpha}_{FeCr}]_{NM} + 2a(1-a)[\Omega^{\alpha}_{FeCo}]_{NM} - 2a[\Omega^{\alpha}_{CoCr}]_{NM} - 2\frac{\partial Tc}{\partial X_{Cr}}\{[{}^{o}S^{\alpha}_{Fe}(T')]_{Mag} - [{}^{o}S^{\alpha}_{Fe}]^{p}_{Mag}\} - \quad (25\text{-}1)$$

$$(1-X_{Cr})\left(\frac{\partial Tc}{\partial X_{Cr}}\right)^2\left[\frac{\partial {}^{o}S^{\alpha}_{Fe}(T')}{\partial T'}\right]_{Mag} - V\left[\sqrt{3}\,\frac{T}{Tc^3}\,\frac{\partial Tc}{\partial X_{Cr}}\{H_o - 2\sqrt{3}\,Nd\frac{I_oT}{Tc}(1-\frac{T}{Tc})^{\frac{1}{2}}\}\times\right.$$

$$\{(I_o\frac{\partial Tc}{\partial X_{Cr}} - 2Tc\frac{\partial I_o}{\partial X_{Cr}})(1-\frac{3}{2}\frac{T}{Tc})(1-\frac{T}{Tc})^{\frac{1}{2}} - \frac{I_oT}{Tc}\frac{\partial Tc}{\partial X_{Cr}}(1-\frac{3}{4}\frac{T}{Tc})(1-\frac{T}{Tc})^{-3/2}\} -$$

$$\left.6Nd\frac{T_2}{Tc^2}\{\frac{\partial I_o}{\partial X_{Cr}}(1-\frac{T}{Tc})^{\frac{1}{2}} - \frac{I_oT}{Tc}\frac{\partial Tc}{\partial X_{Cr}}(1-\frac{3}{2}\frac{T}{Tc})(1-\frac{T}{Tc})^{-\frac{1}{2}}\}^2\right] = 0$$

$(T \leqq 0.99\ Tc)$ $$\frac{RT}{(1-X_{Cr})X_{Cr}} - 2(1-a)[\Omega^{\alpha}_{FeCr}]_{NM} + 2a(1-a)[\Omega^{\alpha}_{FeCo}]_{NM} - 2a[\Omega^{\alpha}_{CoCr}]_{NM} - 2\frac{\partial Tc}{\partial X_{Cr}}\{[{}^{o}S^{\alpha}_{Fe}(T')]_{Mag} - [{}^{o}S^{\alpha}_{Fe}]^{p}\} - \quad (25\text{-}2)$$

$$(1-X_{Cr})\left(\frac{\partial Tc}{\partial X_{Cr}}\right)^2\left[\frac{\partial {}^{o}S^{\alpha}_{Fe}(T')}{\partial T'}\right]_{Mag} - V\left[\frac{q1T}{Tc^3}\,\frac{\partial Tc}{\partial X_{Cr}}\exp(q1\frac{T}{Tc} + q2)\{H_o - 2NdI_o\exp(q1\frac{T}{Tc} + q2)\}\times\right.$$

$$\left.\{(I_o\frac{\partial Tc}{\partial X_{Cr}} - 2Tc\frac{\partial I_o}{\partial X_{Cr}}) + \frac{q1I_oT}{Tc}\frac{\partial Tc}{\partial X_{Cr}}\} - 2Nd\exp 2(q1\frac{T}{Tc} + q2)\{\frac{\partial I_o}{\partial X_{Cr}} - \frac{q1I_oT}{Tc^2}\frac{\partial Tc}{\partial X_{Cr}}\}^2\right] = 0$$

$(T > 0.99\ Tc)$ and the spinodal perpendicular to the magnetic field:

$$\frac{RT}{(1-X_{Cr})X_{Cr}} - 2(1-a)[\Omega^{\alpha}_{FeCr}]_{NM} + 2a(1-a)[\Omega^{\alpha}_{FeCo}]_{NM} - 2a[\Omega^{\alpha}_{CoCr}]_{NM} - 2\frac{\partial Tc}{\partial X_{Cr}}\{[{}^{o}S^{\alpha}_{Fe}(T')]_{Mag} - [{}^{o}S^{\alpha}_{Fe}]^{p}_{Mag}\} - (1-X_{Cr})\left(\frac{\partial Tc}{\partial X_{Cr}}\right)^2\left[\frac{\partial^2 S^{\alpha}_{Fe}(T')}{\partial T'}\right]_{Mag} = 0 \quad (26)$$

We now numerically solve equations (25-1), (25-2) and (26) to draw spinodal curves in a phase diagram with regard to typical values for $H_0$ and Nd. To this end, we will give by assumption the following values to constants in the equations:

$R = 8.32\times10^{-3}$ KJ/mol °K.

${}^{0}Tc = 1043°$ K., $\Delta\tau_1 = 410°$ K., $\Delta\tau_2 = 610°$ K.

${}^{0}I_0 = 2.2$ Wb/m$^3$, $\Delta K_{Cr} = -2.4$ Wb/m$^2$, $\Delta K_{Co} = 1.0$ Wb/m$^2$ $V = 7.1\times10^{-6}$ m$^3$/mol $[{}^{0}S_{Fe}{}^{\alpha}]_{Mag}{}^{p} = 9.0\times10^{-3}$ KJ/mol °K.

It should be noted that the term $[{}^{0}S_{Fe}{}^{\alpha}(T')]_{Mag}$ and the term $$\left[\frac{\partial {}^{o}S^{\alpha}_{Fe}(T')}{\partial T'}\right]_{Mag}$$

can be obtained by a numerical analysis of measured data of magnetic heat of αFe (cf. Acta Met., 11, 323 (1963) L. Kaufman et al).

Figure 2:
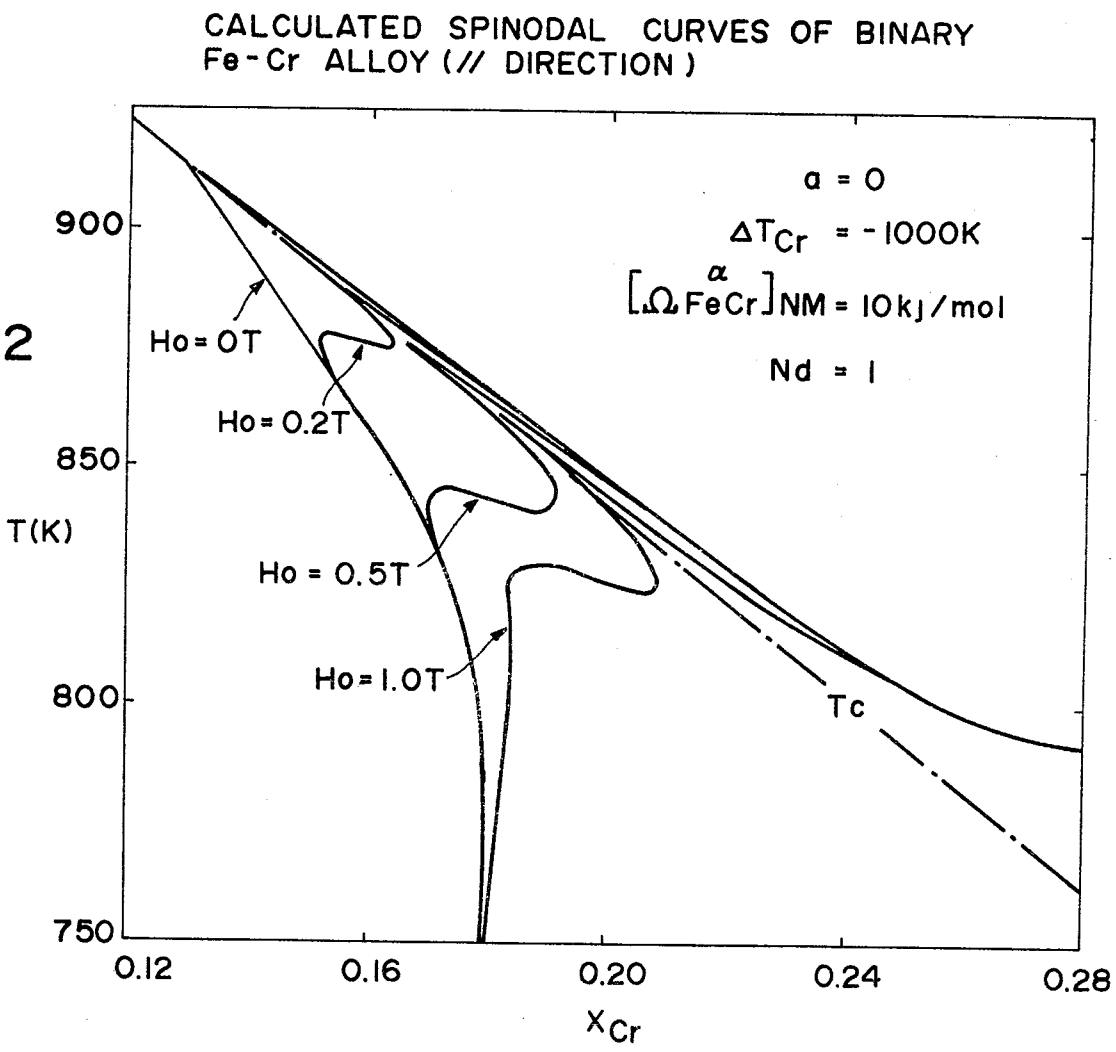

FIG. 1 illustrates curves of spinodal in a phase diagram calculated of its component parallel to magnetization and obtained on the assumption that a=0, indicating that the alloy is binary Fe-Cr alloy, and with regard to four nominal values of 0, 0.2, 0.5 and 1.0T (where 1T=10 KOe) given to $H_0$ while Nd is assumed to be 0. FIG. 2 illustrates curves of spinodal of Fe-Co alloy with regard to its magnetization parallel component similarly obtained on the assumption that Nd is 1. It is shown that when $H_0=0$ or there is no applied magnetic field, the spinodal extends upwardly along the Curie temperature line, forming a "horn" mentioned previously.

When $H_0 \neq 0$ or in the presence of magnetization, the spinodal component in parallel to a field, it is seen that the "horn" below the Curie line is forced downwardly toward the lower temperature region with a degree increasing as the field intensity is greater. It is also seen that the edge of "horn" descends with the greater intensity of field.

Figure 3:
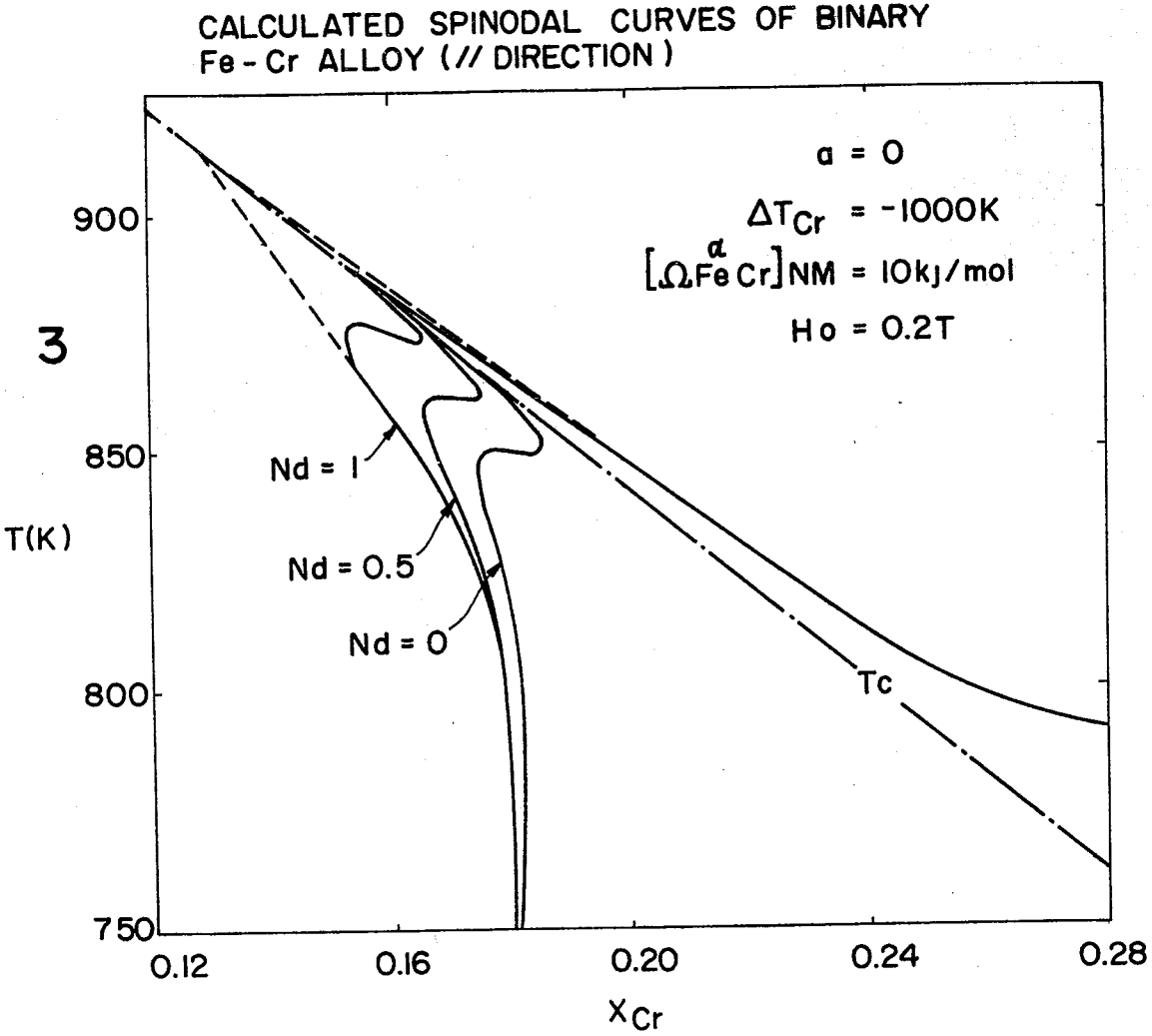

FIG. 3 illustrates curves of spinodal in a phase diagram of its component of Fe-Cr alloy parallel to magnetization obtained on the assumption that H0=0.2T constant with regard to three nominal values of 0, 0.5 and 1 given to Nd. It is shown that the degree with which the edge of the "horn" is forced down toward the lower temperature region is reduced as the demagnetization coefficient increases from 1 to 0. This is seen to be due to a large change in the effective field by the demagnetizing field of a sample if the external field is held constant.

Figure 4:
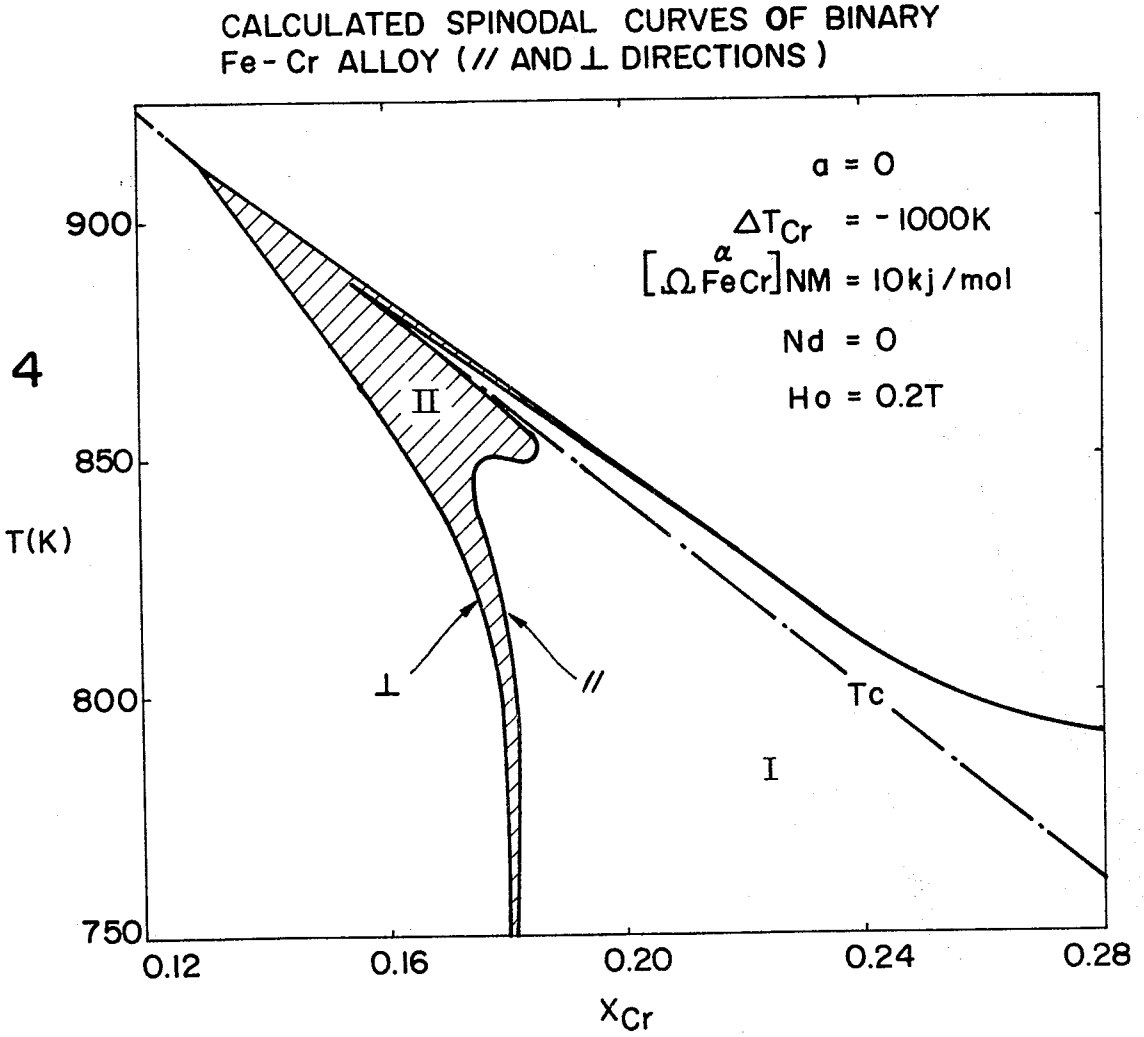
FIG. 4 is a graph shown in a phase diagram depicting spinodal curves taken in the directions which are parallel and perpendicular to magnetization, respectively, in a binary Fe-Co alloy.

FIG. 4 illustrates curves of spinodal each with regard to its components parallel and perpendicular to the external magnetic field on the assumption that Nd and $H_0$ are fixed at 0 and 0.2T, respectively. It is shown that the spinodal curve of component perpendicular to the external field or "perpendicular" spinodal is identical to that in the case in which no field is applied whereas the spinodal curve of component parallel to the field or "parallel" spinodal has the edge of "horn" below the Curie line here again forced downwardly toward the lower temperature region. It is seen therefore that in the vicinity of "horn" there exists an area denoted by II in which the alloy is spinodally decomposable in the perpendicular direction but not so in the "parallel" direction. The area in which the alloy is spinodally decomposable with regard to both "parallel" and "perpendicular" components is denoted by I. FIGS. 1 to 3 show that the area II enlarges as the intensity of external magnetic field is increased and, under a constant external field intensity, also expands as the demagnetization coefficient becomes smaller.

Next, we shall calculate the spinodal of ternary Fe-Cr-Co alloy by assuming a quasi-binary (Fe-20 at % Co)-Cr system or $a=X_{Co}/(X_{Co}+X_{Fe})=0.2$. As regards values for non-magnetic terms of interaction parameters in equations (25-1), (25-2) and (26), the following assumption is made based upon analysis of the phase diagrams of Fe-Cr and Cr-Co binary systems and of the critical temperature of the order-disorder transformation which appears in the Fe-Co binary system:

$$[\Omega^{\alpha}_{FeCr}]_{NM} = 24.70 - 0.0119\ T\ KJ/\text{mol}$$

$$[\Omega^{\alpha}_{FeCo}]_{NM} = -10.5\ KJ/\text{mol}$$

$$[\Omega^{\alpha}_{CrCo}]_{NM} = 21.15 - 0.0338\ T\ KJ/\text{mol}$$

Further, the change of Curie's temperature $\Delta T_{Cr}$ is assumed to be $$\Delta T_{Cr} = -1000°\ \text{K}.$$

and for the intensity of external magnetic field $H_0$, the following is taken as a value which will be used in the customary thermomagnetic treatment:

$$H0=0.2T(=2\ \text{KOe})$$

The demagnetization coefficient Nd is assumed to be of a cylindrical shape with the length/diameter ratio of approximately 5 (with an external magnetic field applied in the longitudinal direction), as follows:

$$Nd=0.04$$

Figure 5:
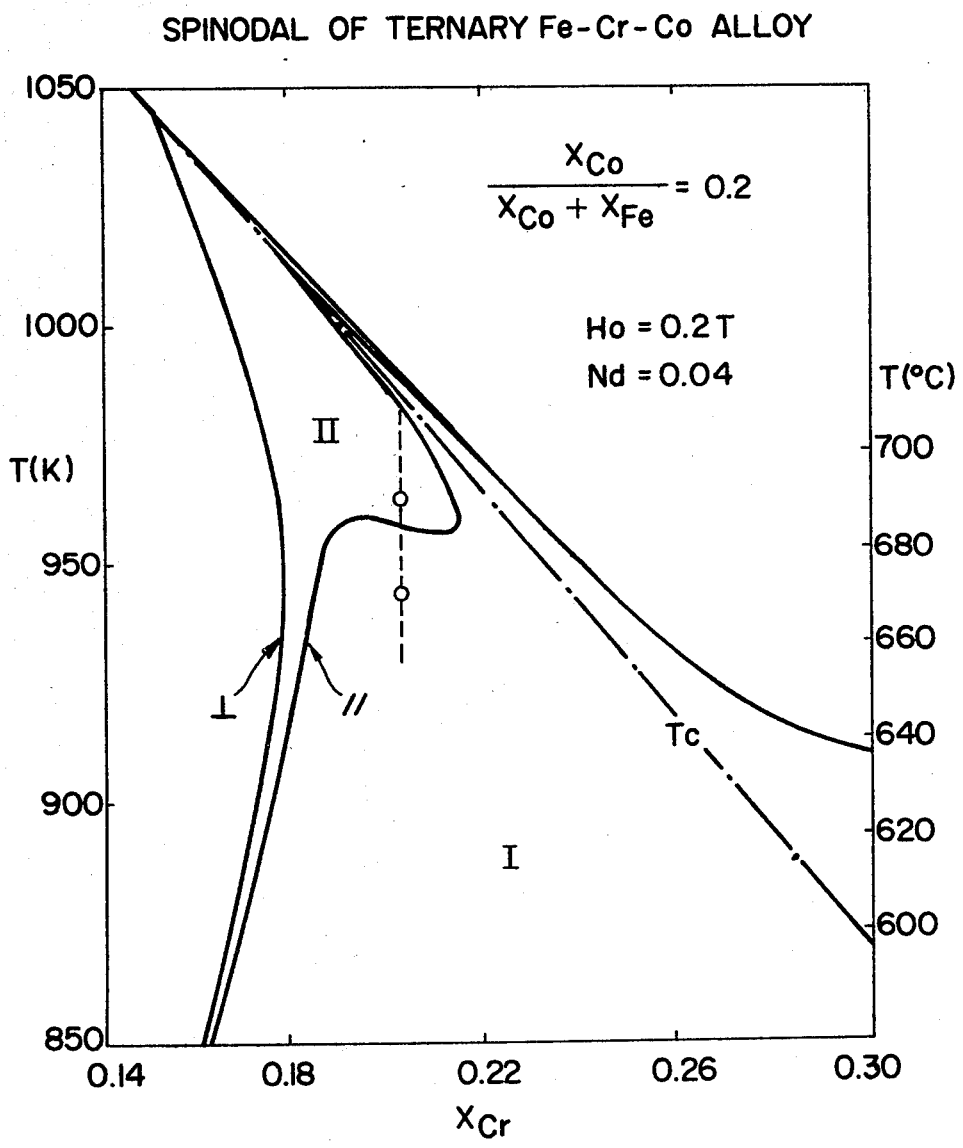
FIG. 5 is a graph similarly depicting two spinodal curves in a ternary Fe-Cr-Co alloy.

FIG. 5 illustrates spinodal curves of the ternary Fe-Cr-Co alloy calculated under the foregoing conditions. It is shown that as in the case a=0, the "perpendicular" spinodal curve is identical to that without the external magnetic field whereas the "parallel" spinodal curve is forced downwardly toward the lower temperature region as to its portion underlying the Curie's temperature line. It is seen therefore that as described in connection with the case a=0, there are two areas in which the alloy is spinodally decomposable:

Area I: the area defined by the "parallel" spinodal curve and in which the alloy is spinodally decomposable in both parallel and perpendicular directions to the external magnetic field; and Area II: the area defined by the "parallel" and "perpendicular" spinodal curves and in which the alloy is spinodally decomposable in the "perpendicular" direction but not so in the "parallel" direction.

The area II is seen to extend over a wide range immediately below the Curie's temperature line at the portion of "horn".

From the above it is noted that a thermomagnetic treatment in the area I allows the alloy to be spinodally decomposed equally in both "parallel" and "perpendicular" directions, thus yielding an isotropically phase-separated structure. A thermomagnetic treatment in the area II causes, however, the alloy to be spinodally decomposed selectively in the "perpendicular" direction, thereby yielding an anisotropically phase-separated structure. In the latter case there is anticipated the structure characterized by the formation of particles of Fe and Co rich $\alpha_1$ phase which are elongated in the direction parallel to the applied magnetic field which acts to impede the decomposition in that direction.

This has been confirmed by experimentation. Thus, a composition typical of the alloy has 20% by atom chromium, 16% by atom cobalt and the balance iron or 18.7% by weight chromium, 17.0% by weight cobalt and the balance iron (which represents $X_{Cr}=0.20$). After solution-treatment at a temperature of 1400° C., the alloy is subjected to a thermomagnetic treatment at different temperatures of 670° C. and 690° C., which fall in the areas I and II, respectively, each for a period of 1 hour under a magnetic field of 2 KOe. The alloy has a cylindrical shape of 6 mm$\phi\times$30 mm and the magnetic field is applied in the longitudinal direction of the cylinder. Then the demagnetization coefficient is 0.04. The alloy treated in the area I shows an isotropically phase-separated structure and therefore has no effect resulting from magnetic tempering or aging. On the other hand, the alloy treated in the area II has an anisotropic phase-separated structure in which cross sections extending parallel to the magnetic field have particles of $\alpha 1$ phase elongated in the particular direction which can be assumed to be that of the magnetic field. Cross sections perpendicular to the field have particles with their cross section approximately circular. It can thus been seen that a thermomagnetic treatment in the area II yields a structure in which elongated $\alpha 1$ phase particles are uniformly oriented in the direction of a magnetic field applied during that treatment.

Figure 6:
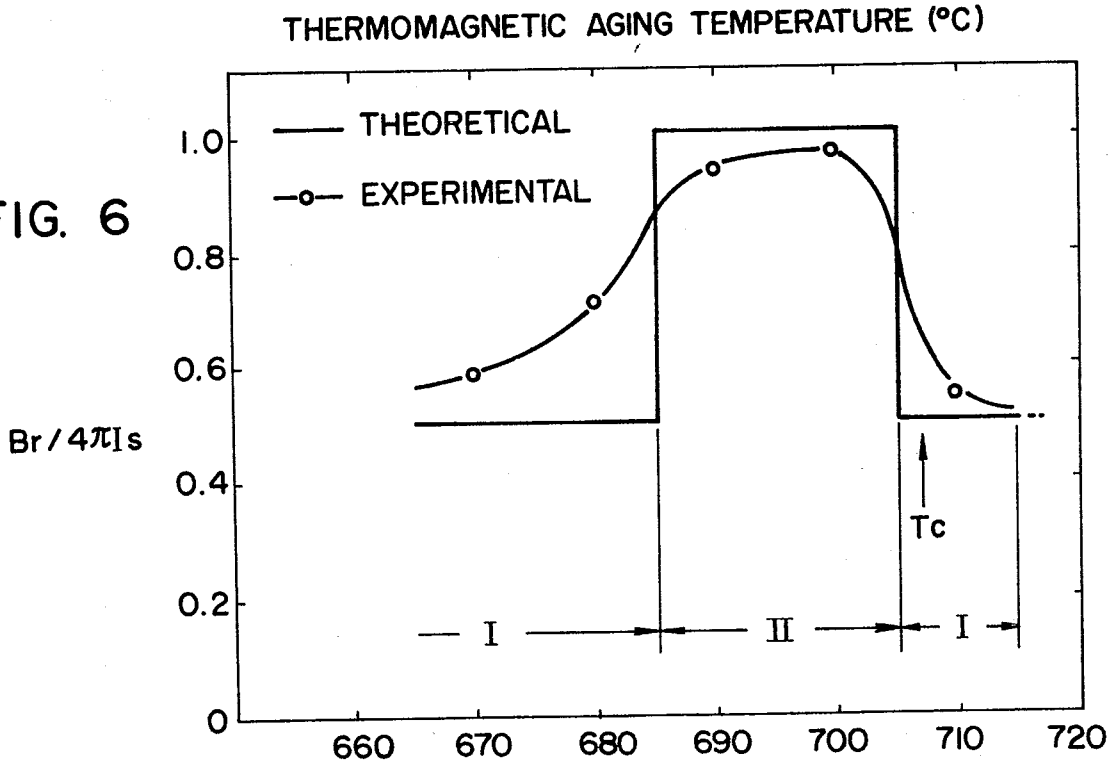
FIG. 6 is a graph depicting magnetic rectangularity or squareness ($Br/4\pi Is$) curves, derived both theoretically and experimentally, respectively, each plotted with respect to a thermomagnetic treatment temperature.
Figure 7:
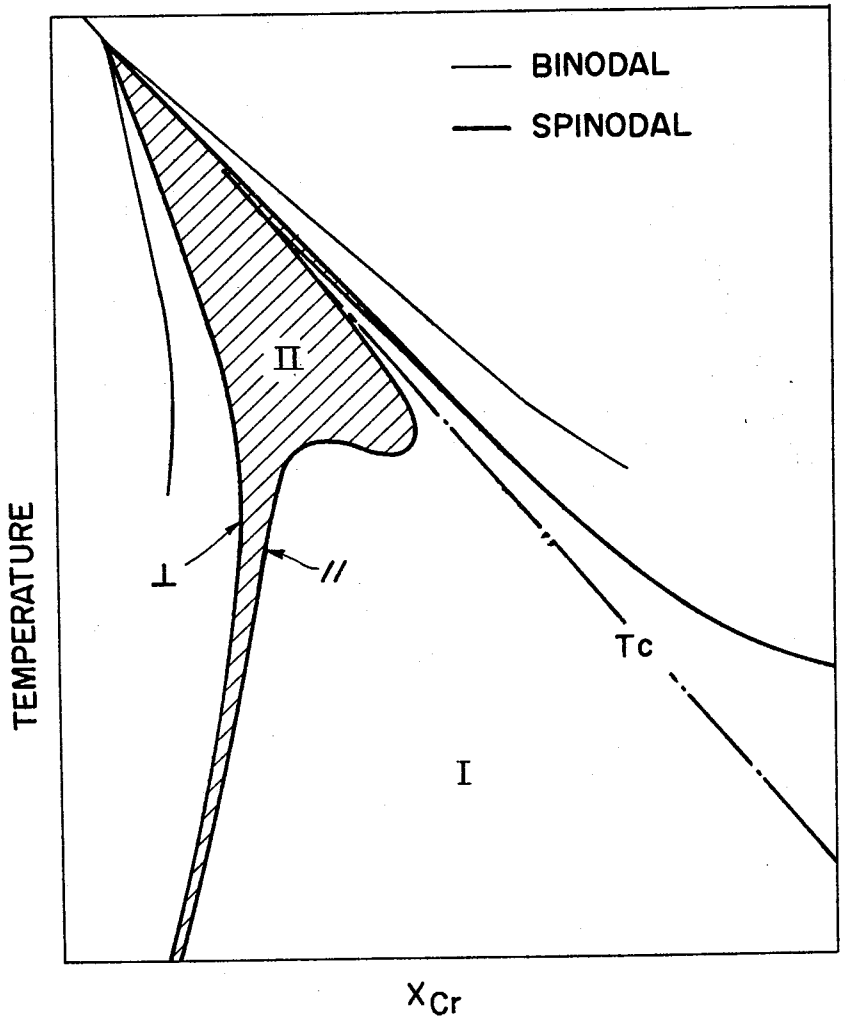
FIG. 7 is a graph diagrammatically illustrating an area in which a thermomagnetic treatment is effective.

The relationship between spinodal curves and magnetic rectangularity or squareness (Br/4$\pi$Is) of the alloy is now investigated. As a typical example, a composition consisting of 18.7% by weight chromium, 17.0% by weight cobalt and the balance iron is again used which is retained at different temperatures between 670° and 710° C., each for 1 hour under a magnetic field of 2 KOe, for the purpose of thermomagnetic treatment or magnetic tempering thereof. The relationship between the rectangularity (Br/4$\pi$Is) and the thermomagnetic temperature with regard to both theoretical and experimental values is shown in FIG. 6. The theoretical values are based upon a certain model [cf. E. C. Stoner, E. P. Wohlfarth: Phil. Trans. Roy. Soc., 204, 599 (1948)] in the single-domain particle theory of unidirectional anisotropy according to which a mass of particles oriented in a given direction has a rectangularity of 1 while a mass of randomly oriented particles has a rectangularity of 0.5. The observation of samples prepared as above shows that the thermomagnetic treatment in the area II yields grater values of rectangularity which approach 1 and the thermomagnetic treatment in the area I yields lower vaues of rectangularity approaching 0.5. It is thus shown that to impart anisotropy requires a thermomagnetic treatment in the area II. This area in which the thermomagnetic treatment is effective is indicated diagrammatically in FIG. 7 by shaded portion. As noted previously, this area increases with the strength of external magnetic field applied and also expands as the demagnetization coefficient of a body of alloy is reduced. In FIG. 7, a binodal (miscibility gap) curve of the alloy system is also shown.

Our discovery described in the foregoing regarding a spinodally decomposing system in a state of equilibrium is now investigated as to its applicability to the actual production of magnetic products of a composition of this particular class by reviewing how the $\alpha$ phase of the alloy is to be decomposed into $\alpha 1$ and $\alpha 2$ phases with the lapse of time.

Figure 8:
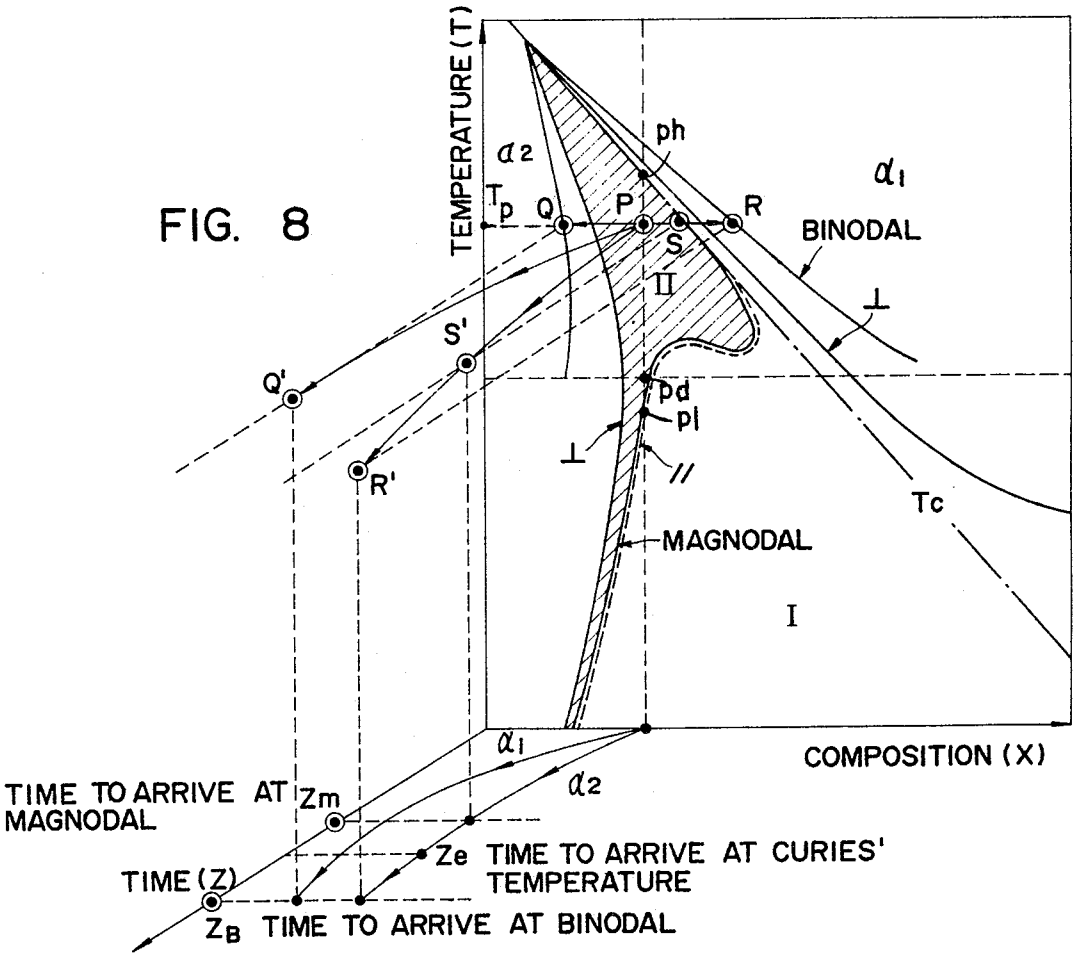
FIG. 8 is a graph shown in a phase diagram illustrating thermomagnetic treatment conditions in accordance with the present invention.

FIG. 8 is a phase diagram of an Fe-Cr-Co alloy basically identical to that shown in FIG. 7, further incorporating the time axis (Z) therein which corresponds to the thermomagnetic treatment in an external magnetic field.

As described previously, the area II in the phase diagram is defined by a "parallel" spinodal or spinodal curve denoted by || applicable to thermomagnetic treatment parallel to the magnetic field and a "perpendicular" spinodal or a spinodal curve denoted by $\perp$ applicable to thermomagnetic treatment perpendicular to the magnetic field. The "parallel" spinodal which thus defines the area II with the higher concentration side of the area (I) or the area in which the thermomagnetic treatment is ineffective is herein called "magnodal" for the sake of convenience.

Let us assume that a composition denoted by P which has previously been solution-treated to form a homogeneous $\alpha$ phase is thermomagnetically treated at a temperature $T_p$. Since this point falls within the area II, the alloy is anisotropically decomposable with its $\alpha$ phase selectively in the direction of the magnetic field into a phase-separated $\alpha_1+\alpha_2$ structure.

As indicated in the diagram, the $\alpha_1$ phase is composition-modulated with time to follow a path from the point P to a point Q(Q') at which a binodal (miscibility gap) curve is reached where the composition modulation terminates. On the other hand, the $\alpha_2$ phase will follow a path from the point P to a point R(R') to undergo a composition modulation which terminates when it arrives at the binodal. In the way the $\alpha_2$ phase must traverse the magnodal at a point denoted by S(S'). Since this latter point defines the anisotropy-imparting area II with the ineffective or harmful area I, it is seen that the thermomagnetic treatment must be conducted in the time Zm which correspond to the arrival of $\alpha_2$ phase at the magnodal or point S and no excessive time should be consumed. This is also apparent from the fact that when the $\alpha_2$ phase goes beyond the point S to reach the Curie's temperature, there results no influence of the magnetic field. It is apparent that the time limitation above is peculiar to the $\alpha_2$ phase and is not imposed on the $\alpha_1$ phase. It is thus seen that the $\alpha_2$ phase constitutes a rate-determining step.

It will be appreciated that the temperature range of a thermomagnetic treatment which can be employed effectively lies between the upper limit ph and lower limit pl where the composition p traverses the magnodal in the higher and lower temperature sides, respectively. However, when the point pl lies below the diffusion temperature pd, the latter can be used as a preferred lower limit since the range pd-pl will provide no essential advantage.

Regarding magnetic cooling or a cooling treatment in a magnetic field, it should be noted that there has been established heretofore no well-based rule to determine the upper and lower limits of temperature. The foregoing discovery shows, however, that the temperatures should not be optional and a critical range between ph and pl or pd should be strictly observed to avoid meaningless magnetic cooling steps at lower temperatures on one hand to avoid harmful results arising from any temperature deviation from the critical range on the other hand.

Thus, in a thermomagnetic treatment in which the thermomagnetic treatment in which the magnetic field is of constant intensity and the temperature is reduced continuously or stepwise, the initial temperature should not exceed a point at which the magnodal is traversed and should not be dropped below the lower limit p1 or, where pl is greater than pd, the latter.

Likewise, in a thermomagnetic treatment in which the temperature is constant or successively reduced and the magnetic field is varied or, as is typical, successively increased, the magnodal or the "parallel" spinodal below the Curie's temperature curve shifts toward the low temperature region to enlarge the thermomagnetically treatable area II and should be strictly observed to maintain the temperatures to be above the shifting magnodal.

There is thus provided an improved method of producing a thermomagnetically treated magnetic alloy to provide an anisotropically magnetic object. The present invention is applicable to a wide range of spinodally decomposable alloys which are anisotropically magnetizable. For example, the invention is applicable surprisingly to an Fe-Cr-Co alloy of lower cobalt proportion, say with the cobalt content lower than 10% by weight which has been considered to be impossible to achieve magnetic properties attainable by a high-cobalt Fe-Cr-Co alloy, say with the cobalt content not less than 15%, thus to achieve a maximum energy product, say, of 7 megagaus-oersteds or more.

What is claimed is:

1. A method of producing a magnetically anisotropic object from a spinodal decomposition-type alloy system wherein a homogeneous $\alpha$ phase is spinodally decomposable into an isomorphous structure of a ferromagnetic $\alpha_1$ phase and a paramagnetic $\alpha_2$ phase in a magnetic field, said method comprising the steps of: establishing a formula expressed as a function of temperature and composition for the total free energy of said alloy system and expressed as a sum of the chemical free energy of said alloy system and an additional term, said chemical free energy being resolved into a nonmagnetic component and a magnetic component thereof, said additional term being constituted by a free energy of magnetization of said alloy system and expressed with an intensity of said magnetic field taken as a parameter; calculating spinodal of said alloy system from said free energy formula by obtaining the locus of disappearance of a second derivative thereof to yield a first spinodal component applicable in parallel with the direction of said magnetic field and a second spinodal component applicable perpendicular to the direction of said magnetic field; drawing as curves said first and second spinodal components along with a curve representing the Curie's temperature of said alloy system in a phase diagram to establish an area therein defined by said first and second spinodal curves in conjunction with said Curie's temperature curve; and thermomagnetically treating said alloy system within said area.

2. The method defined in claim 1 wherein said free energy term of magnetization is expressed with an intensity of the magnetic field taken as a parameter.

3. The method defined in claim 2 wherein said free energy term of magnetization is expressed further with a demagnetization of said alloy system taken as a parameter.

4. The method defined in claim 1 or claim 2 wherein said step of thermomagnetic treatment includes controlling the time period thereof with the decomposition of said alloy system into said paramagnetic $\alpha_2$ phase taken as a rate-determining process so that the treatment continues until before the concentration modulation of said $\alpha_2$ phase traverses said first spinodal curve or magnodal.

5. The method defined in claim 1, claim 2, claim 3 or claim 4 wherein said step of thermomagnetic treatment is effected at a temperature not lower than a critical diffusion temperature of said alloy system.

* * * * *